United States Patent [19]

Biceroglu et al.

[11] Patent Number: 4,462,895

[45] Date of Patent: Jul. 31, 1984

[54] COMBINATION VISBREAKING AND HYDROREFINING WITH RECYCLE OF HYDROREFINED BOTTOMS

[75] Inventors: Omer Biceroglu; Bruce M. Sankey, both of Sarnia, Canada

[73] Assignee: Exxon Research & Engineering Co., Florham Park, N.J.

[21] Appl. No.: 469,747

[22] Filed: Feb. 25, 1983

[51] Int. Cl.[3] ..... C10G 65/12; C10G 69/06

[52] U.S. Cl. ..... 208/59; 208/68; 208/73; 208/76; 208/211

[58] Field of Search ..... 208/68, 211, 57, 59, 208/73, 76

[56] References Cited

U.S. PATENT DOCUMENTS

| | | | |
|---|---|---|---|
| 2,321,841 | 6/1943 | Mekler et al. | 208/67 |
| 2,352,025 | 6/1944 | Seguy | 208/68 |
| 2,666,022 | 1/1954 | Johnson | 208/68 |
| 3,050,457 | 8/1962 | Wilson | 208/67 |
| 3,132,088 | 5/1964 | Beuther et al. | 208/67 |
| 3,193,487 | 7/1965 | Beuther et al. | 208/68 |
| 3,338,818 | 8/1967 | Paterson | 208/58 |
| 3,349,023 | 10/1967 | Paterson | 208/68 |
| 3,379,639 | 4/1968 | Vallino, Jr. | 208/80 |
| 3,671,419 | 6/1972 | Ireland et al. | 208/57 |
| 3,684,694 | 8/1972 | Hanson et al. | 208/89 |
| 3,691,058 | 9/1972 | Hamner et al. | 208/73 |
| 3,738,931 | 6/1973 | Frankovich et al. | 208/67 |
| 3,806,444 | 4/1974 | Crouch et al. | 208/68 |
| 4,366,047 | 12/1982 | Winter et al. | 208/89 |
| 4,400,264 | 8/1983 | Kwant et al. | 208/68 |

*Primary Examiner*—Delbert E. Gantz
*Assistant Examiner*—O. Chaudhuri
*Attorney, Agent, or Firm*—Marthe L. Gibbons

[57] ABSTRACT

A heavy hydrocarbon oil comprising constituents boiling above 1050° F. is upgraded by a combination visbreaking or hydrovisbreaking and hydrorefining process in which at least a portion of the hydrorefined bottoms fraction is recycled to the visbreaking zone. The hydrorefining zone is operated at conditions to convert at least a portion of the 1050° F.+ constituents to lower boiling hydrocarbons.

10 Claims, 4 Drawing Figures

○ Once-through Visbreaking of Virgin Cold Lake Crude

■ Recycle of Hydrogenated 510°C+ Bottoms (Batch #1)

▲ Recycle of Hydrogenated 510°C+ Bottoms (Batch #2)

Recycle Ratio: Virgin Cold Lake Crude (Fresh Feed)/Hydrogenated Bottoms= 2/1 wt/wt ○ Once-through Visbreaking of Virgin Cold Lake Crude ■ Recycle of Hydrogenated 510°C+ Bottoms (Batch #1)

▲ Recycle of Hydrogenated 510°C+ Bottoms (Batch #2)

Recycle Ratio: Virgin Cold Lake Crude (Fresh Feed)/Hydrogenated Bottoms = 2/1 wt/wt

COMBINATION VISBREAKING AND HYDROREFINING WITH RECYCLE OF HYDROREFINED BOTTOMS

BACKGROUND OF THE INVENTION

1. Field of the Invention

The present invention relates to an improvement in a combination visbreaking and hydrorefining process for upgrading hydrocarbonaceous oils.

2. Description of the Prior Art

Visbreaking is a well-known mild thermal cracking process to which heavy hydrocarbonaceous oils may be subjected to reduce their viscosity by depolymerization and cracking in the liquid phase. See, for example, *Hydrocarbon Processing,* September 1978, page 106.

The term "hydrorefining" is used herein to designate a catalytic treatment conducted in the presence of added hydrogen, of a hydrocarbonaceous oil to upgrade the oil by eliminating or reducing the concentration of contaminants in the oil such as sulfur compounds, nitrogenous compounds and metal contaminants, hydrogenation of unsaturated constituents of the oil and conversion of at least a portion of the heavy constituents of the oil.

U.S. Pat. No. 2,321,841 discloses visbreaking a heavy hydrocarbonaceous oil and thereafter nondestructively catalytically hydrogenating the visbroken oil. The hydrogenated bottoms may be recycled to the visbreaking zone.

U.S. Pat. No. 3,338,818 discloses hydrovisbreaking a hydrocarbonaceous oil. The lighter fraction of the hydrovisbroken oil is catalytically hydrogenated. The hydrogenated bottoms are recycled to the hydrovisbreaking zone.

U.S. Pat. No. 3,050,457 discloses hydrovisbreaking a crude shale oil and catalytically hydrogenating the light fraction. The overhead gases are recycled from the hydrogenation zone to the hydrovisbreaking zone.

U.S. Pat. No. 3,132,088 discloses visbreaking a residual oil and catalytically hydrogenating the deasphalted bottoms of the visbroken oil.

It has now been found that a combination visbreaking, hydrorefining at conditions to convert at least a portion of the heavy constituents of the visbroken oil and a recycling of the hydrorefined bottoms to the visbreaking zone will provide advantages that will become apparent in the ensuing description.

SUMMARY OF THE INVENTION

In accordance with the invention there is provided, a process for upgrading a heavy hydrocarbonaceous oil which comprises the steps of:

(a) treating a chargestock comprising a fresh heavy hydrocarbonaceous oil comprising at least about 10 volume percent materials boiling above 1050° F. and a hydrorefined bottoms fraction recycled from step (d) in a visbreaking zone at visbreaking conditions to produce a visbrokekn oil product, said visbroken oil comprising materials boiling above 1050° F.;

(b) contacting at least a portion of said visbroken oil with a hydrorefining catalyst in the presence of added hydrogen in a hydrorefining zone at hydrorefining conditions such as to convert at least about 5 weight percent of the materials boiling above 1050° F. of said visbroken oil to lower boiling hydrocarbons, said hydrorefining conditions including a hydrogen partial pressure of at least 1000 psig, to produce a hydrorefined effluent including a normally gaseous phase and a normally liquid phase, including normally liquid hydrocarbons;

(c) separating the hydrorefined oil product resulting from step (b) into fractions, including a hydrorefined heavy bottoms fraction, and (d) recycling at least a portion of the separated hydrorefined heavy bottoms fraction to said visbreaking zone.

By the terms "normally liquid" and "normally gaseous" are intended herein that the components are liquid or gaseous, respectively, at standard temperature and pressure conditions.

DESCRIPTION OF THE PREFERRED EMBODIMENTS

Figure 1:
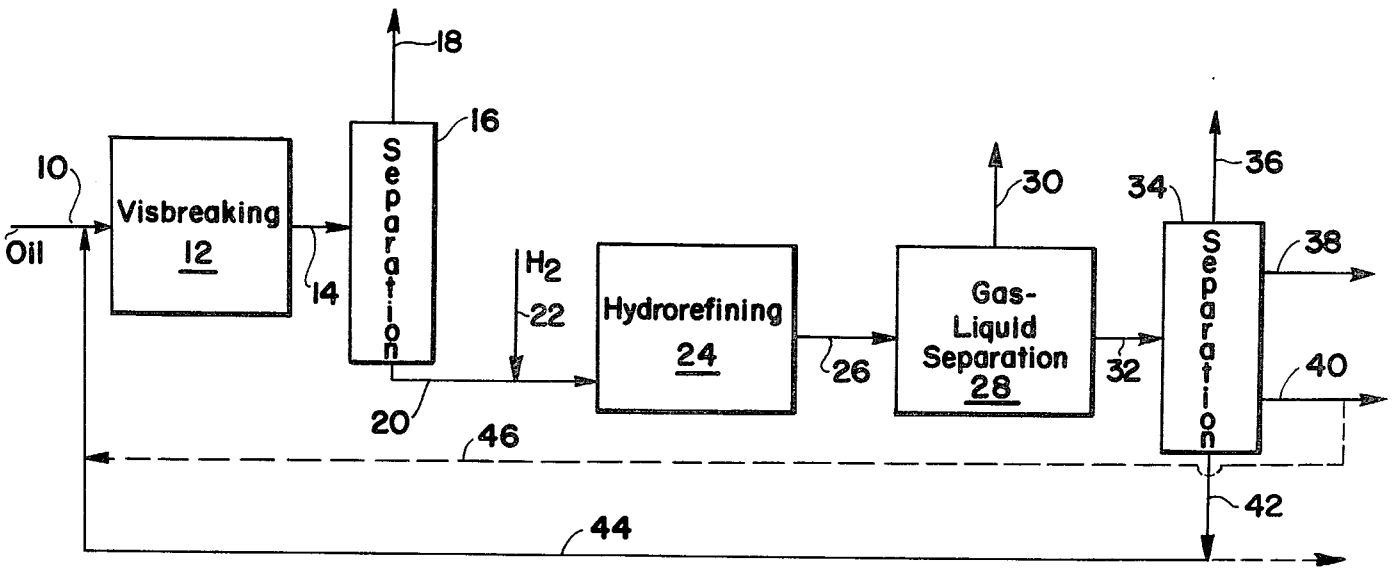
FIG. 1 is a schematic flow plan of one embodiment of the invention.

Referring to FIG. 1, a fresh heavy hydrocarbonaceous oil comprising materials boiling above 1050° F. and a recycled hydrorefined bottoms fraction (line 44) are passed by line 10 into visbreaking zone 12. All boiling points referred to herein unless otherwise specified are atmospheric pressure boiling points.

Fresh Heavy Hydrocarbon Oils

Suitable fresh heavy hydrocarbon oils for the visbreaking zone of the present invention are: hydrocarbonaceous oils comprising at least 10 volume percent materials boiling above about 1050° F., preferably at least 25 volume percent boiling above 1050° F. The 1050° F.+ materials generally include asphaltenes. The initial boiling point of such oils will generally range from about 550° to 650° F., although whole crude oils may be used. Suitable oil feeds for the visbreaking zone include heavy crude mineral oils; residual petroleum fracions such as atmospheric residua and vacuum residua. Such oil feeds usually contain large amounts of sulfur and may contain metallic contaminants such as nickel and vanadium. The total metal content of such oils may range up to 2000 weight part per million or more, and the sulfur content may range from at least 0.5 weight percent to 8 weight percent or more. The Conradson carbon residue of the oils will be above 2 weight percent, preferably from 5 to 50 weight percent, and more preferably above 7 weight percent (as to Conradson carbon, see ASTM Test D 189-65). The heavy hydrocarbon oil may be derived from any source such as petroleum, shale oil, tar sand oil, heavy oils produced by coal liquefaction processes, etc., and mixtures thereof. The preferred oil feed is a petroleum residuum obtained from distillation or other treating or separation process.

Visbreaking Operating Conditions

Suitable visbreaking conditions in visbreaking zone 12 include a temperature ranging from about 750° to 950° F., preferably from about 800° to about 920° F., a pressure ranging from 50 to 1500 psig, preferably from 100 to 1000 psig, more preferably from 200 to 800 psig. The visbreaking zone may be a coil disposed in a furnace. In such an embodiment, the stated temperatures refer to coil outlet temperatures and the preferred pressures are coil outlet pressures ranging from 200 to 800 psig. If desired, a hydrogen-containing gas may be introduced into the visbreaking zone to conduct hydrovisbreaking. The heavy hydrocarbonaceous oil chargestock is maintained at visbreaking conditions only for a time sufficient to convert not more than 50 volume percent of the 700° F.+ constituents to products boiling below 700° F. Under the above conditions, the heavy oil chargestock is partially converted to lower boiling hydrocarbon products. The effluent of the visbreaking zone is passed by line 14 to separation zone 16, which may be a flash zone, wherein the lighter boiling materials are removed overhead by line 18 and the heavier visbroken oil product is removed by line 20, mixed with a hydrogen-containing gas, preferably containing more than 70 percent hydrogen, introduced into line 20 by line 22 and passed into hydrorefining zone 24. The initial boiling point of the visbroken oil removed by line 20 from separation zone 16 may range from 100° to 1000° F. The visbroken oil portion introduced into hydrorefining zone 24 comprises unsaturated hydrocarbons, materials boiling above 1050° F. and usually sulfur contaminants.

The Hydrorefining Catalyst

The hydrorefining catalyst present in hydrorefining zone 24 can be any conventional hydrorefining catalyst. Suitable hydrorefining catalysts include a hydrogenation component, such as Group VIB and a Group VIII metal, metal oxide, metal sulfide and mixtures thereof, composited with a support, such as an alumina-containing support. The catalyst may be, for example, a catalyst comprising cobalt, molybdenum, nickel, tungsten and mixtures thereof on an alumina support, which may additionally comprise phosphorous and/or silica. Suitable catalysts are described, for example, in U.S. Pat. Nos. 3,770,618; 3,509,044 and 4,113,656, the teachings of which are hereby incorporated by reference.

Suitable operating conditions in the hydrorefining zone are summarized in Table I.

TABLE I

HYDROREFINING OPERATING CONDITIONS

| Conditions | Broad Range | Preferred Range |
|---|---|---|
| Temperature, °F. | 600–850 | 650–800 |
| Total pressure, psig | 1000–3000 | 1000–2500 |
| Liquid hourly space velocity, V/V/HR | 0.05–5.0 | 0.1–2.5 |
| Hydrogen rate, SCF/BBL | 300–10,000 | 2000–6000 |
| Hydrogen partial pressure, psig | 1000–3000 | 1000–2000 |

The hydrorefining zone is operated at conditions, including a hydrogen partial pressure of at least 1000 psig, such that at least about 5 weight percent, preferably more than 10 weight percent of the 1050° F.+ materials of the portion of the visbroken oil introduced into the hydrorefining zone is converted to lower boiling hydrocarbon products while simultaneously hydrogenating unsaturated hydrocarbons, converting asphaltenes to non-asphaltenes, and desulfurizing, and demetallizing the visbroken oil. The hydrorefining zone effluent is passed by line 26 to separation zone 28 wherein a normally gaseous phase, including hydrogen, hydrogen sulfide, light hydrocarbon gases and which may comprise ammonia, is separated from a normally liquid phase which includes normally liquid hydrorefined hydrocarbon oil. The normally gaseous phase is removed from separation zone 26 by line 30. If desired, hydrogen sulfide may be removed by conventional methods from the gaseous phase recovered by line 30 and the substantially hydrogen-sulfide free hydrogen-containing gas may be recycled to hydrorefining zone 24. Optionally, the hydrogen-containing gaseous phase recovered by line 30 may be recycled to visbreaking zone 12 with or without prior hydrogen sulfide removal. The hydrorefined oil product is removed by line 32 and passed to separation zone 34 such as a fractional distillation zone, to separate the oil into light gases removed overhead by line 36, a naphtha fraction recovered by line 38, an intermediate boiling fraction recovered by line 40 and a heavy hydrorefined bottoms fraction comprising material boiling above 1050° F. removed by line 42. At least a portion of the bottoms fraction is recycled by line 44 to line 10 in which is carried a fresh heavy oil feed for introduction into visbreaking zone 12. The bottoms fraction is recycled at a volumetric ratio of bottoms fraction to fresh oil feed ranging from 0.1:1 to 5:1, preferably at a volumetric ratio ranging from 0.5:1 to 2:1. If desired, a portion of the intermediate fraction may also be recycled to the visbreaking zone 12 via line 46.

Figure 2:
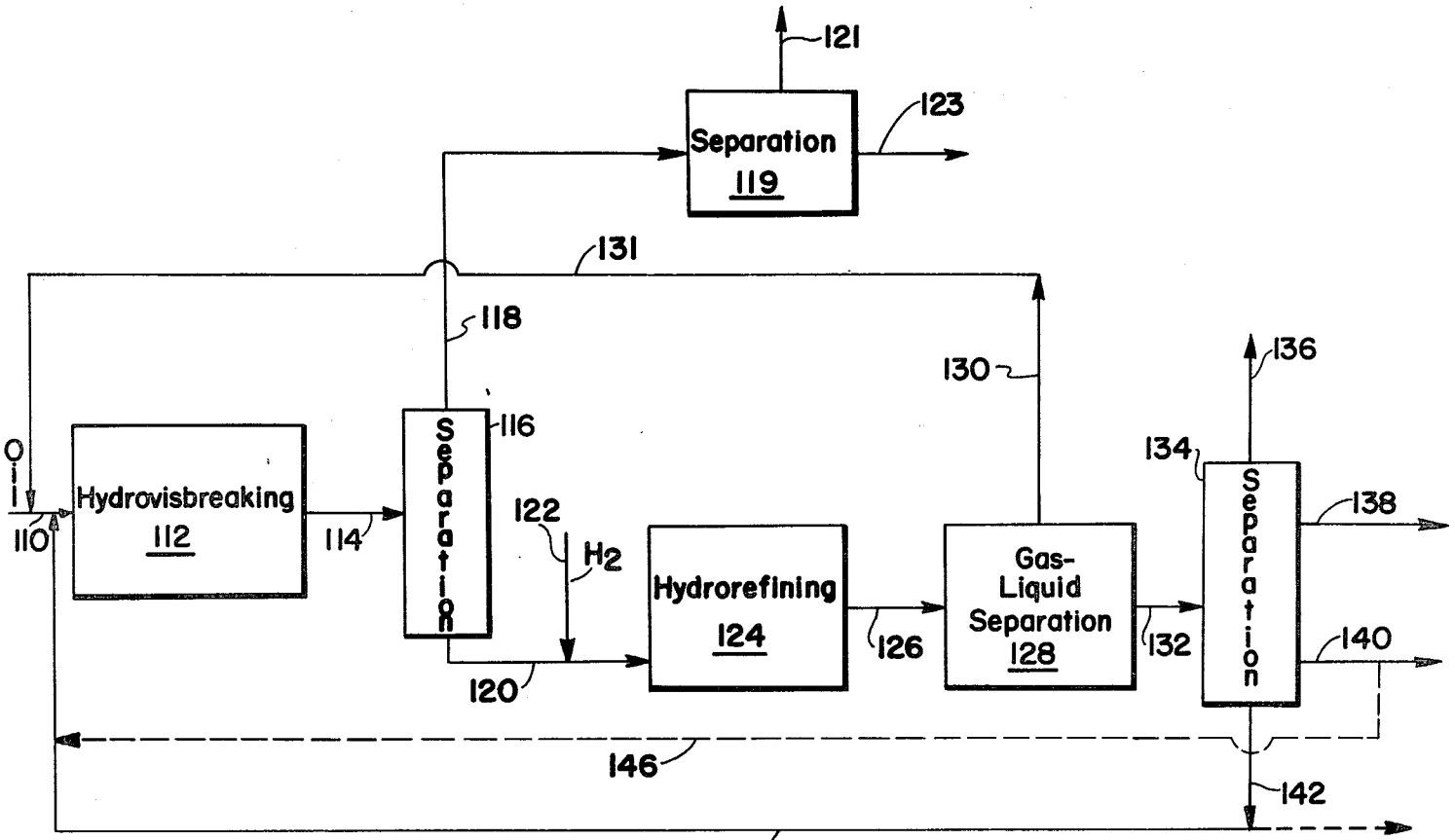
FIG. 2 is a schematic flow plan of another embodiment of the invention.

The FIG. 2 embodiment differs from the FIG. 1 embodiment in that the hydrogen and hydrogen sulfide-containing gas recovered from the hydrorefining zone effluent is recycled to the visbreaking zone which is operated as a hydrovisbreaking process. Hydrogen sulfide is removed from the gases recovered from the hydrovisbreaking effluent and the substantially hydrogen sulfide free hydrogen-containing gas is recycled to the hydrorefining zone. Referring to FIG. 2, a fresh heavy oil feed of the same type as described with reference to FIG. 1 is passed by line 110 to hydrovisbreaking zone 112. The hydrovisbreaking zone effluent is passed by line 114 to separation zone 116 (such as a flash zone) wherein a normally gaseous phase is separated from a normally liquid phase. The gaseous phase is passed by line 118 to separation zone 119 in which a gaseous phase is separated from a normally liquid hydrocarbon phase. The hydrogen and hydrogen sulfide-containing gaseous phase is removed by line 121. If desired, hydrogen sulfide may be removed from the gaseous phase and the resulting hydrogen-containing gas may be recycled to line 122. The normally liquid hydrocarbon phase is recovered by line 123. The liquid hydrovisbroken oil from separation zone 116 is passed by line 120 to hydrorefining zone 124. A fresh or recycled hydrogen-containing gas or mixtures thereof is introduced into line 120 by line 122. Hydrorefining zone 124 is operated at the same conditions and comprises the same type of hydrorefining catalyst as described with reference to FIG. 1. The hydrorefining zone effluent is passed by line 126 to separation zone 128 wherein a gaseous phase is separated from the hydrorefined oil phase. The gaseous phase, which comprises hydrogen, hydrogen sulfide, ammonia and light gaseous hydrocarbons, is removed by line 130 and passed by line 131 into oil feed line 110 for introduction into the hydrovisbreaking zone 112. The hydrorefined oil is passed by line 132 into separation zone 134 in which it is separated into fractions. Light gases are removed by line 136. A naphtha fraction is removed by line 138. An intermediate boiling fraction is removed by line 140. The hydrorefined bottoms fraction, comprising materials boiling above 1050° F., is removed by line 142 and recycled by line 144 to fresh oil feed line 110 in the same volumetric ratio as previously described with reference to FIG. 1. If desired, a portion of the intermediate fraction 140 may be recycled to oil feed line 110 by line 144.

The following examples are presented to illustrate the invention.

EXAMPLE 1

A fresh virgin whole Cold Lake crude oil was visbroken. The visbroken product was distilled to obtain a 300° C.+ (572° F.+) residuum. The visbroken residuum was hydrorefined utilizing a conventional cobalt-molybdenum on alumina hydrorefining catalyst. The total hydrorefined liquid product was distilled to obtain a 510° C.+ (950° F.+) hydrorefined bottoms portion. These steps represent a first-pass operation. The operating conditions and results of these process steps are summarized in Table II. The hydrorefined bottoms fraction (recycle) and fresh whole Cold Lake crude oil were blended in a volumetric ratio of 1:2. The blend was visbroken. Visbreaking of the blend simulates a second-pass operation in accordance with the present invention. Table II summarizes data for a typical second-pass visbreaking which includes the recycle hydrorefined bottoms portion. The conversion of 510° C.+ on fresh feed (recycle free basis) was 58 LV%, in contrast to 31 LV% obtained without recycle.

TABLE II

DATA FROM FIRST-PASS OF VISBREAKING AND HYDROREFINING OPERATION

| | FIRST-PASS | | | |
|---|---|---|---|---|
| | VISBREAKING | | HYDROREFINING | |
| PROCESS STEP STREAM CUT TEMPERATURE | FEED (WHOLE CRUDE) | PRODUCT (TOTAL LIQUID) | FEED (572° F.+) | PRODUCT (TOTAL LIQUID) |
| Total Stream | | | | |
| Gravity, °API at 60° F. | 10.3 | 13.7 | 6.4 | 16.4 |
| Carbon, wt % | 82.26 | — | — | 87.29 |
| Hydrogen, wt % | 10.59 | — | — | 11.16 |
| Sulphur, wt % | 4.43 | 4.36 | 4.51 | 0.795 |
| Nitrogen, wt % | 0.41 | — | 0.51 | 0.32 |
| CCR(1), wt % | 13.1 | 14.8 | 18.2 | 8.3 |
| NI(2), wt % | 12.7 | 12.7 | 16.2 | 6.4 |
| Metals, wppm | | | | |
| Nickel | 77 | 77 | 99 | 27.1 |
| Vanadium | 190 | 190 | 245 | 54.2 |
| 950° F.+ Residuum | | | | |
| Yield, LV % | 54.0 | 37.4 | 50.5 | 37.8 |
| Sulphur, wt % | 5.8 | 5.4 | 5.5 | 1.79 |
| CCR, wt % | 22.9 | 35.8 | 35.8 | 20.4 |
| NI, wt % | 22.2 | 30.7 | 30.7 | — |
| Metals, wppm | | | | |
| Nickel | 135 | 186 | 186 | 67 |
| Vanadium | 333 | 459 | 459 | 133 |
| Conversion of 950° F.+ | | | | |
| LV % | — | 30.7 | — | 24.2 |
| wt % | — | 27.5 | — | 22.8 |
| Operating Conditions | | | | |
| Temperature, °F. | — | 838 | — | 700–734 |
| Space Velocity, v/h/v | — | tc 5–10 | — | 0.3–0.6 |
| $H_2$ Pressure, psi | — | 200 | — | 2000 |
| $H_2$ Rate, SCF/B | — | Nil | — | 6000 |
| % Desulphurization | | | | 82.4 |
| % Denitrogenation | | | | 37.3 |
| % Nickel removal | | | | 72.6 |
| % Vanadium removal | | | | 77.9 |
| % CCR(1) removal | | | | 54.4 |
| % NI(2) removal | | | | 60.5 |

(1)CCR denotes Conradson carbon residue
(2)NI denotes naphtha insolubles

TABLE III

DATA FROM SECOND-PASS OF VISBREAKING OPERATION

| | SECOND-PASS VISBREAKING | | | |
|---|---|---|---|---|
| | FEED | | | |
| STREAM | FRESH FEED (WHOLE CRUDE) | RECYCLE (HYDRO-GENATED 950° F.+) | TOTAL FEED (BLEND) | PRODUCT (TOTAL LIQUID) |
| Yield, LV % | 67.2 | 32.8 | 100 | 101.9 |
| Yield, WT % | 66.7 | 33.3 | 100 | 99.7 |
| Gravity, °API at 60° F. | 10.3 | 5.9 | 9.4 | 12.5 |
| Carbon, wt % | 82.26 | — | 83.79 | 84.96 |
| Hydrogen, wt % | 10.59 | — | 10.23 | 10.17 |
| Sulphur, wt % | 4.43 | 1.79 | 3.55 | — |
| Nitrogen, wt % | 0.41 | — | | |

TABLE III-continued

DATA FROM SECOND-PASS OF VISBREAKING OPERATION

| STREAM | SECOND-PASS VISBREAKING FEED: FRESH FEED (WHOLE CRUDE) | RECYCLE (HYDRO-GENATED 950° F.+) | TOTAL FEED (BLEND) | PRODUCT (TOTAL LIQUID) |
|---|---|---|---|---|
| Toluene insolubles, wt % | Nil | Nil | Nil | 0.1 |
| CCR[1], wt % | 13.1 | 20.4 | 15.5 | 17.5 |
| NI[2], wt % | 12.7 | 15.7 | 13.7 | 14.1 |
| Metals, wppm | | | | |
| Nickel | 77 | 67 | 74 | 74 |
| Vanadium | 190 | 133 | 171 | 171 |
| Yield of 675° F.+, LV % | 82.5 | 100 | 88.2 | 74.6 |
| Yield of 950° F.+, LV % | 54.0 | 100 | 69.0 | 48 |
| , wt % | 57.1 | 100 | 71.4 | 52.4 |
| Conversion of 950° F.+ on Fresh Feed, LV % | — | — | — | 58.1 |
| Operating Conditions | | | | |
| Temperature, °F. | | | | 824 |
| Space velocity, v/h/v | | | | 3.2 |
| Pressure, psi | | | | 200 |

[1]CCR denotes Conradson carbon residue
[2]NI denotes naphtha insolubles

EXAMPLE 2

Figure 3:
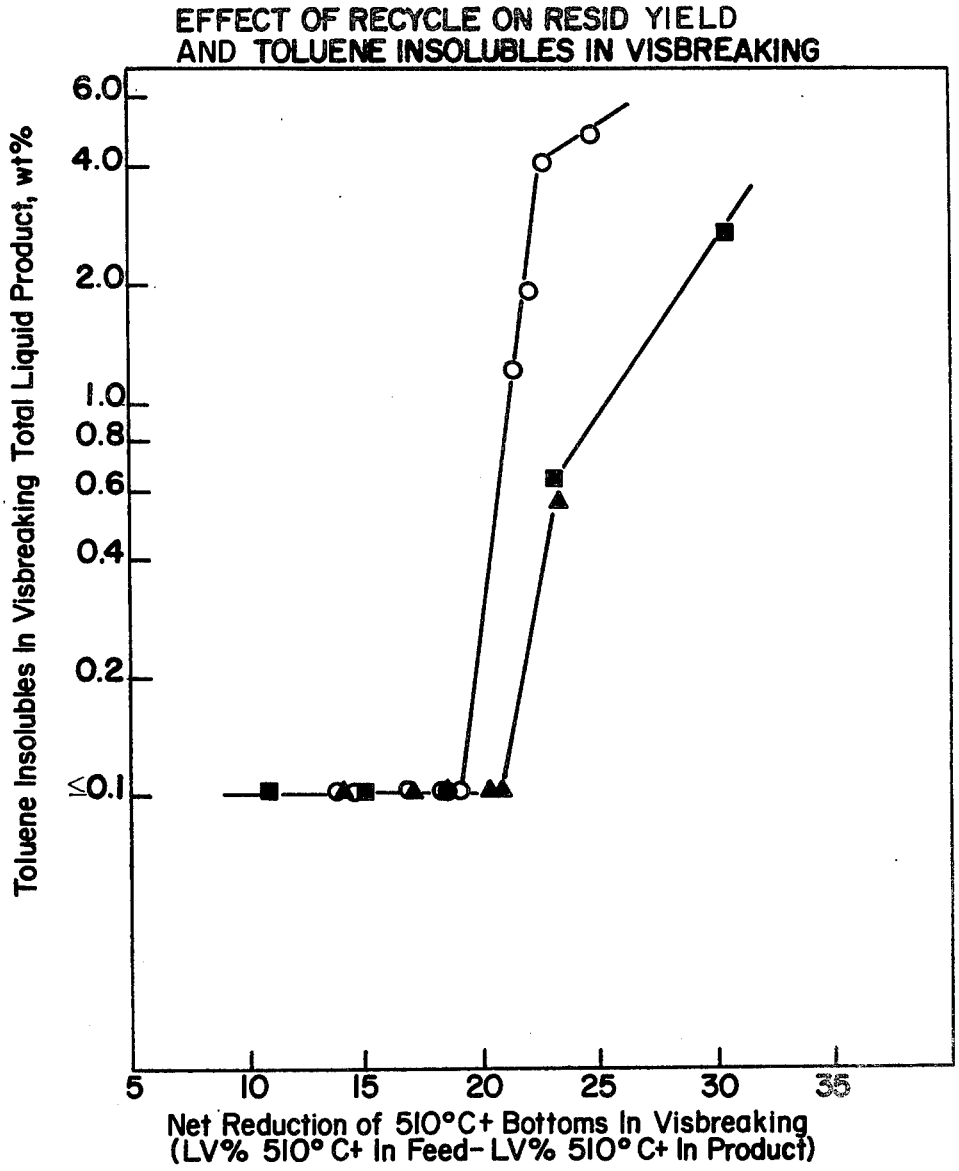
FIG. 3 is a graph showing effect of recycle on residuum yield and toluene insoluble in visbreaking.
Figure 4:
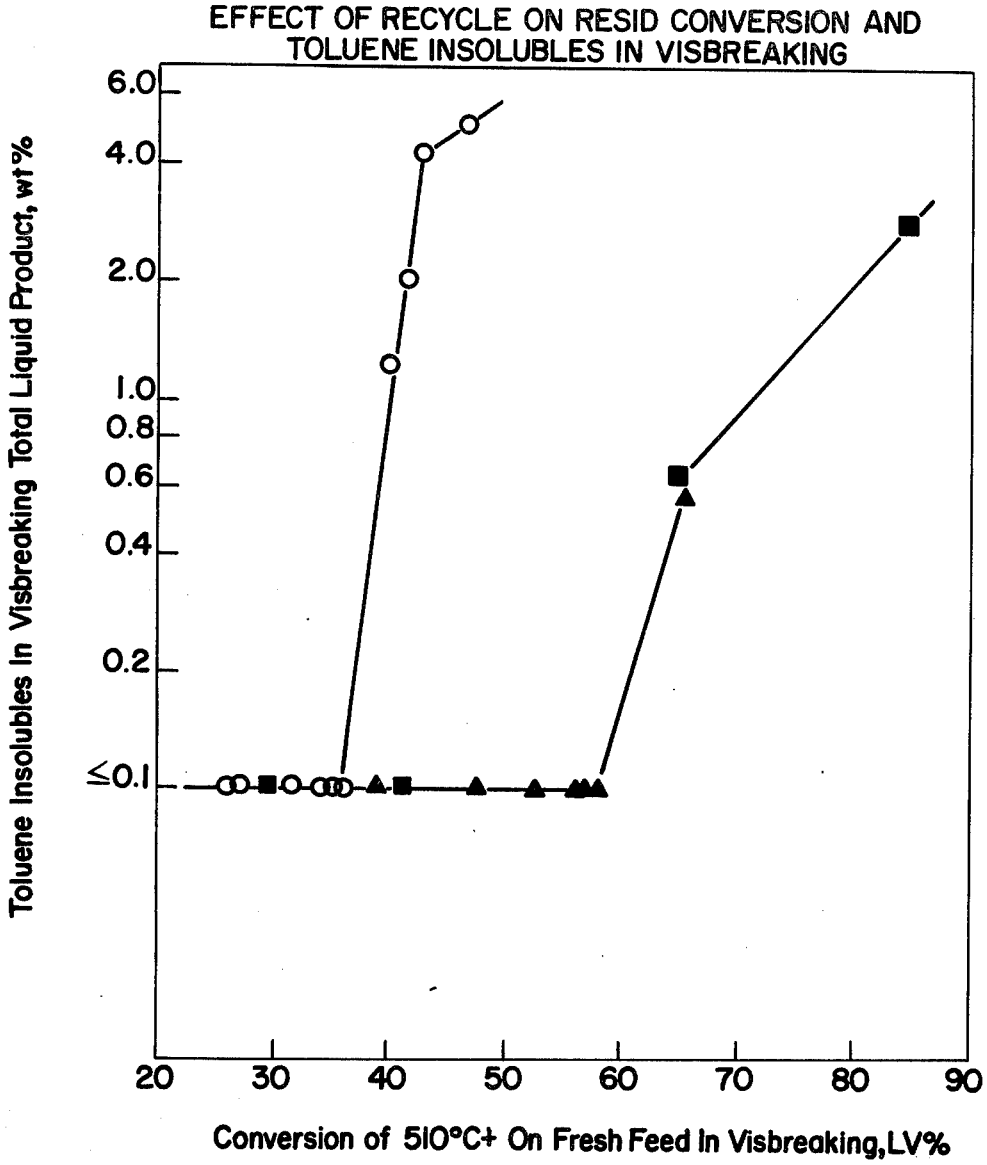
FIG. 4 is a graph showing effect of recycle on residuum conversion and toluene insoluble in visbreaking.

To demonstrate the effect of recycling hydrorefined bottoms on visbreaking performance, the visbreaking step was operated at different severities with and without recycle. The results of these tests were summarized in the graphs of FIGS. 3 and 4. FIG. 3 shows toluene insolubles in total visbroken product versus reduction of 510° C.+ (950° F.+) yield with and without recycle. Toluene insolubles are indications of coke forming tendency. As shown in FIG. 3, recycle of hydrorefined bottom produced less toluene insolubles at a given bottoms reduction or achieved higher bottoms reduction at a given toluene insolubles. FIG. 4 shows toluene insolubles versus conversion of 510° C.+ (950° F.+) as expressed on fresh feed. Under operable conditions, visbreaking without recycle converted only 35% of the 510° C.+ in fresh feed, whereas with recycle, about 60% of the 510° C.+ materials were converted while toluene insolubles remained low (about 0.1 wt.%).

What is claimed is:

1. A process for upgrading a heavy hydrocarbonaceous oil, which comprises the steps of:

(a) treating a chargestock comprising a fresh heavy hydrocarbonaceous oil containing at least about 10 volume percent materials boiling above 1050° F. and a hydrorefined bottoms fraction recycled from step (d) in a visbreaking zone at visbreaking conditions to produce a visbroken oil product, said visbroken oil comprising materials boiling above 1050° F.;

(b) contacting at least a portion of said visbroken oil with a hydrorefining catalyst in the presence of added hydrogen in a hydrorefining zone at hydrorefining conditions such as to convert at least about 5 weight percent of the materials boiling above 1050° F. of said visbroken oil to lower boiling hydrocarbons, said hydrorefining conditions including a hydrogen partial pressure of at least 1000 psig, to produce a hydrorefined effluent comprising a normally gaseous phase and a normally liquid phase, including normally liquid hydrocarbons;

(c) separating the hydrorefined oil product resulting from step (b) into fractions, including a hydrorefined heavy bottoms fraction, and (d) recycling at least a portion of the separated hydrorefined heavy bottoms fraction comprising materials boiling above 1050° F. to said visbreaking zone, at a volumetric ratio of recycled bottoms fraction to said fresh oil ranging from about 0.1:1 to 5:1.

2. The process of claim 1 wherein said fresh heavy hydrocarbonaceous oil comprises sulfur and metallic contaminants and wherein said hydrorefining conditions of step (b) are such as to desulfurize and demetallize at least partially said portion of visbroken oil.

3. The process of claim 1 wherein said visbreaking conditions include a temperature ranging from 750° to 950° F. and a pressure ranging from 50 to 1500 psig.

4. The process of claim 1 wherein said hydrorefining conditions include a temperature ranging from about 600° to 850° F. and a total pressure ranging from 1000 to 3000 psig.

5. The process of claim 1 wherein said hydrorefining conditions include a temperature ranging from 650° to 800° F. and a total pressure ranging from 1000 to 2500 psig.

6. The process of claim 1 wherein said fresh heavy hydrocarbonaceous oil feed comprises at least about 25 volume percent materials boiling above 1050° F.

7. The process of claim 1 wherein said oil feed is treated in said visbreaking zone in the presence of added hydrogen.

8. The process of claim 1 wherein said hydrorefined effluent is separated into said normally gaseous phase and into said normally liquid phase and wherein at least a portion of said normally gaseous phase is recycled to said visbreaking zone.

9. The process of claim 1 wherein said hydrorefining catalyst comprises a hydrogenation component selected from the group consisting of a Group VIB metal component, a Group VIII metal component and mixtures thereof, and an alumina-containing support.

10. The process of claim 1 wherein said chargestock of step (a) comprises constituents boiling above 700° F. and wherein said visbreaking conditions are conducted for a time sufficient to convert not more than 50 volume percent of 700° F.+ constituents to products boiling below 700° F.

* * * * *